US009404621B2

(12) United States Patent
Suzuki et al.

(10) Patent No.: US 9,404,621 B2
(45) Date of Patent: Aug. 2, 2016

(54) FUEL TANK VALVE

(75) Inventors: Yutaka Suzuki, Kobe (JP); Kaoru Nomichi, Ono (JP); Makoto Ninomiya, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 257 days.

(21) Appl. No.: 14/345,593

(22) PCT Filed: Sep. 12, 2012

(86) PCT No.: PCT/JP2012/005793

§ 371 (c)(1),
(2), (4) Date: May 16, 2014

(87) PCT Pub. No.: WO2013/038664

PCT Pub. Date: Mar. 21, 2013

(65) Prior Publication Data

US 2014/0352817 A1 Dec. 4, 2014

(30) Foreign Application Priority Data

Sep. 16, 2011 (JP) ..... 2011-203271

(51) Int. Cl.
*F17C 13/02* (2006.01)
*F17C 13/04* (2006.01)

(52) U.S. Cl.
CPC ..... *F17C 13/04* (2013.01); *F17C 13/026* (2013.01); *F17C 2201/0104* (2013.01);
(Continued)

(58) Field of Classification Search
CPC .... F17C 13/026; F17C 13/04; F17C 2205/03; F17C 2205/0302; F17C 2205/0323; F17C 2205/0341; F17C 2205/0382; F17C 2205/0388; F17C 2250/0439; F17C 2250/0631
USPC ..... 141/66, 83, 94
See application file for complete search history.

(56) References Cited

U.S. PATENT DOCUMENTS 7,210,496 B2 * 5/2007 Suzuki ..... F16K 1/302 137/338
7,377,294 B2 * 5/2008 Handa ..... B60K 15/00 141/82

(Continued)

FOREIGN PATENT DOCUMENTS

DE 10 2006 004 120 A1 7/2007
JP A-2005-180496 7/2005

(Continued)

OTHER PUBLICATIONS

International Search Report issued in International Application No. PCT/JP2012/005793 mailed Nov. 27, 2012.

(Continued)

*Primary Examiner* — Nicolas A Arnett
(74) *Attorney, Agent, or Firm* — Oliff PLC

(57) ABSTRACT

The present invention includes: a valve main body including a filling port through which a fuel gas is filled in a tank and an output port through which the fuel gas in the tank is output; and a jet flow deflection piece through which the fuel gas to be filled through the filling port is ejected at a predetermined angle relative to an axial direction of the tank. The jet flow deflection piece includes: a fuel ejecting portion including an ejection port through which the fuel gas is ejected into the tank; and a temperature measuring portion in which a temperature sensor configured to measure a temperature of the fuel gas to be filled in the tank is provided. Thus, the temperature of the fuel gas when filling the fuel tank with the fuel gas can be precisely measure and monitored.

7 Claims, 4 Drawing Sheets

(52) U.S. Cl.
CPC ..... *F17C 2205/0305* (2013.01); *F17C 2205/0323* (2013.01); *F17C 2205/0382* (2013.01); *F17C 2205/0388* (2013.01); *F17C 2227/04* (2013.01); *F17C 2250/0439* (2013.01); *F17C 2250/0631* (2013.01); *Y10T 137/8122* (2015.04)

(56) References Cited

U.S. PATENT DOCUMENTS

| | | | | |
|---|---|---|---|---|
| 8,413,951 | B2 * | 4/2013 | Nomichi | F16K 31/06 137/468 |
| 2002/0050142 | A1 * | 5/2002 | Wang | F17C 7/02 62/48.1 |
| 2003/0066836 | A1 * | 4/2003 | Sakaguchi | F17C 1/06 220/581 |
| 2008/0110514 | A1 * | 5/2008 | Yoshida | H01M 8/04089 137/628 |
| 2009/0107570 | A1 * | 4/2009 | Weber | F17C 1/16 138/30 |
| 2009/0236551 | A1 | 9/2009 | Nomichi et al. | |
| 2010/0206887 | A1 | 8/2010 | Hashim et al. | |
| 2011/0068286 | A1 * | 3/2011 | Nomichi | F16K 31/0655 251/129.15 |
| 2013/0186487 | A1 * | 7/2013 | Nomichi | F02M 21/0239 137/487 |

FOREIGN PATENT DOCUMENTS

| | | |
|---|---|---|
| JP | B2-3864815 | 1/2007 |
| JP | A-2007-232151 | 9/2007 |
| JP | 2010-015847 A | 1/2010 |
| WO | 02/12779 A1 | 2/2002 |

OTHER PUBLICATIONS

Jun. 8, 2015 Extended Search Report issued in European Application No. 12832157.7.

* cited by examiner

FUEL TANK VALVE

TECHNICAL FIELD

The present invention relates to a fuel tank valve provided at a fuel tank.

BACKGROUND ART

Conventionally, a fuel tank is provided with a fuel tank valve that is a master valve type directly attached to the tank such that a fuel gas can be filled in the tank and can be output when the gas is used.

FIG. 6 is a cross-sectional view showing this type of fuel tank. Typically, a fuel tank 100 is formed in a substantially cylindrical shape and has a dual structure constituted by: a tank inner member 101 made of metal or the like and having high airtightness; and a tank outer member 102 made of a high tension material that is light in weight. A valve 103 is provided at one end of the tank 100, and the other end of the tank 100 is closed by a plug 104.

According to the structure shown in FIG. 6, in a case where a high-pressure fuel gas G is filled in the fuel tank 100 through the valve 103 attached to the tank 100, the temperature in the vicinity of a tank rear end that is directly hit by the jet flow of the fuel gas G increases. At the time of a high-pressure filling operation, the fuel tank 100 distorts by heat expansion caused by a partial temperature increase.

Here, as this type of conventional art, the fuel tank 100 shown in FIG. 7 is configured such that when filling the fuel tank 100 with the fuel gas G, the fuel gas G is diffused at an angle $\alpha$ through an ejection port 116 of an ejection port unit 115 provided at a valve 113, so that the distortion of the fuel tank 100 by the partial heat expansion is prevented (see PTL 1, for example).

CITATION LIST

Patent Literature

PTL 1: Japanese Patent No. 3864815

SUMMARY OF INVENTION

Technical Problem

There is an increasing demand for a configuration in which to prevent an abnormal temperature increase of the fuel tank at the time of the filling operation, the temperature of the gas in the fuel tank is measured and monitored when filling the fuel tank with the high-pressure fuel gas.

Here, the present inventors have though of a configuration in which a temperature sensor is incorporated in a valve directly attached to a fuel tank. In addition, the present inventors have also thought of a configuration in which when filling the tank with the high-pressure fuel gas, the temperature sensor incorporated in the valve is prevented from being damaged by the fuel gas.

PTL 1 does not describe that a temperature sensor is provided at a valve in a tank structure. Therefore, according to the tank structure of PTL 1, it is difficult to precisely measure and monitor the temperature of the high-pressure gas, and the temperature sensor may be damaged by the high-pressure fuel gas.

Solution to Problem

An object of the present invention is to provide a fuel tank valve capable of precisely measuring and monitoring the temperature of the fuel gas when filling the fuel tank with the fuel gas.

To achieve the above object, the present invention is a fuel tank valve including: a valve main body including a filling port through which a fuel gas is filled in a tank and an output port through which the fuel gas in the tank is output; and a jet flow deflection piece through which the fuel gas to be filled through the filling port is ejected at a predetermined angle relative to an axial direction of the tank, wherein the jet flow deflection piece includes: a fuel ejecting portion including an ejection port through which the fuel gas is ejected into the tank; and a temperature measuring portion in which a temperature sensor configured to measure a temperature of the fuel gas to be filled in the tank is provided. In the present description and claims, the "fuel gas" denotes a high-pressure "hydrogen gas", "natural gas", or the like. With this configuration, the fuel gas to be filled in the tank through the filling port of the valve main body can be ejected at a predetermined angle relative to the axial direction of the tank by the ejection port of the jet flow deflection piece, and the temperature of the fuel gas to be filled can be precisely measured and monitored.

The jet flow deflection piece may include an introducing passage through which a part of the fuel gas to be filled through the fuel ejecting portion is introduced into the temperature measuring portion. With this configuration, the temperature of the fuel gas to be filled can be more precisely measured and monitored.

The jet flow deflection piece may include a bulkhead portion formed between the temperature measuring portion and the fuel ejecting portion, and the introducing passage may be provided at such a position that the fuel gas to be filled through the fuel ejecting portion does not directly hit the temperature sensor. With this configuration, the fuel gas at the time of the high-pressure filling operation can be prevented from directly hitting the temperature sensor by the bulkhead portion, and the temperature of the fuel gas can be precisely measured and monitored while preventing the temperature sensor from being, for example, damaged by the fuel gas.

The jet flow deflection piece may include the ejection port formed on a side surface of the jet flow deflection piece such that the fuel gas is ejected along an inner surface of the tank. With this configuration, since the fuel gas is ejected to be filled through the ejection port of the jet flow deflection piece along the inner surface of the tank, the local temperature increase of the tank can be suppressed.

The ejection port may be formed such that the fuel gas is ejected in a direction rotated about a filling hole from a direction perpendicular to the axial direction of the tank by a predetermined angle in a circumferential direction, the filling hole communicating with the filling port. With this configuration, since the fuel gas ejected through the ejection port of the jet flow deflection piece along the inner surface of the tank is filled in the tank so as to spirally flow at a predetermined angle, the local temperature increase of the tank can be further suppressed.

The jet flow deflection piece may include: an output hole that communicates with the output port; and a filter configured to remove foreign matters in the fuel gas to be output through the output hole to the output port. With this configuration, the filter can be easily replaced by replacing the jet flow deflection piece.

The valve main body may include a filter configured to remove foreign matters in the fuel gas to be output to the output port, the filter being provided on a surface of the valve main body, the surface being joined to the jet flow deflection piece. With this configuration, by detaching the jet flow deflection piece, the filter can be easily detected from the valve main body to be replaced.

The valve main body may include a valve attaching portion to which an on-off valve provided inside the tank is attached, and the jet flow deflection piece may include an opening portion that externally fits the on-off valve attached to the valve attaching portion. With this configuration, in the fuel tank valve configured such that the on-off valve is provided inside the tank, the fuel gas can be filled so as to be ejected at a predetermined angle relative to the axial direction of the tank by the ejection port of the jet flow deflection piece, and the temperature of the fuel gas to be filled can be more precisely measured and monitored by the temperature sensor.

Advantageous Effects of Invention

According to the present invention, the temperature increase of the fuel tank at the time of the filling operation can be suppressed, and the temperature of the fuel gas can be precisely measured and monitored at the time of the filling operation.

DESCRIPTION OF EMBODIMENTS

Figure 6:
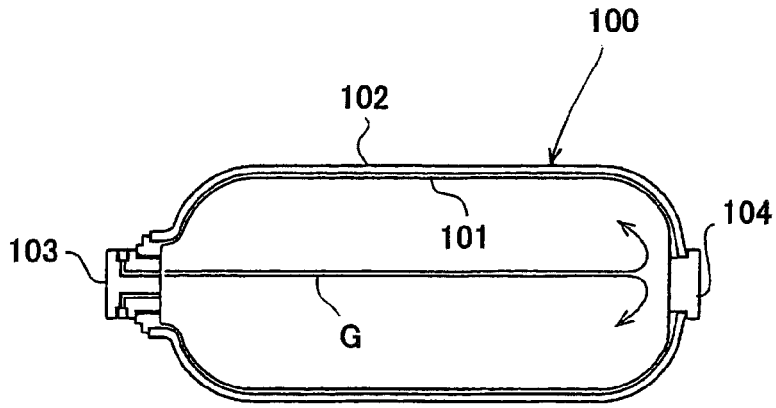
FIG. 6 is a longitudinal sectional view showing a conventional fuel tank.
Figure 7:
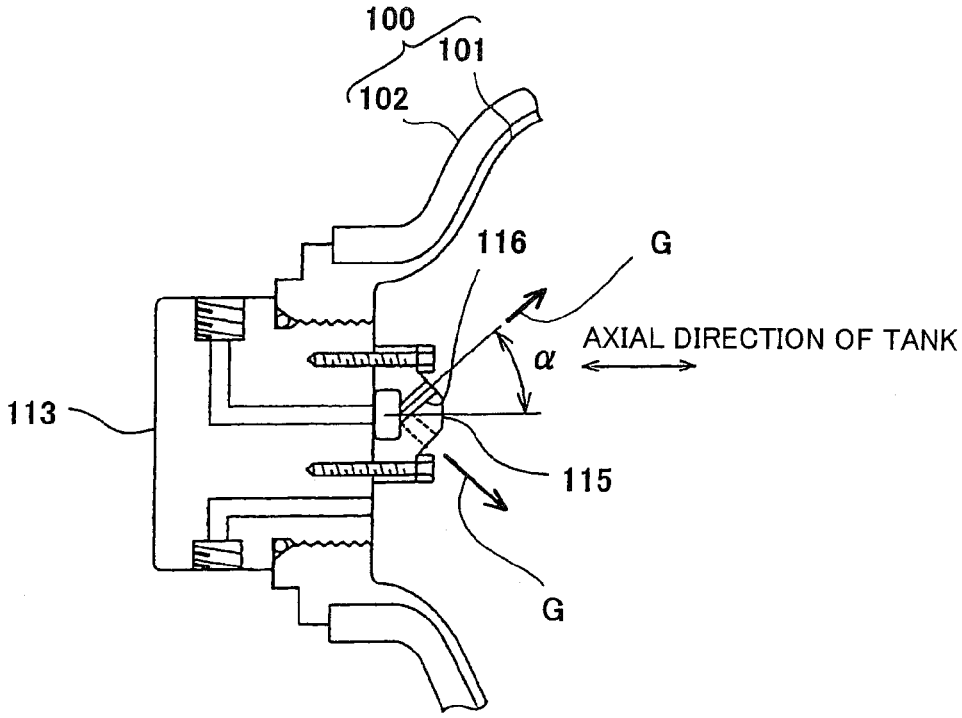
FIG. 7 is a cross-sectional view showing a valve portion of a conventional fuel tank.

Hereinafter, one embodiment of the present invention will be explained based on the drawings. In the following embodiment, a fuel tank valve will be explained based on enlarged cross-sectional views. As with the fuel tank 100 shown in FIG. 6 described above, a fuel tank 100 is formed in a substantially cylindrical shape and will be explained using the same reference sign. The fuel gas G to be filled is shown by a solid arrow, and the fuel gas G to be output is shown by a dashed arrow.

Figure 1:
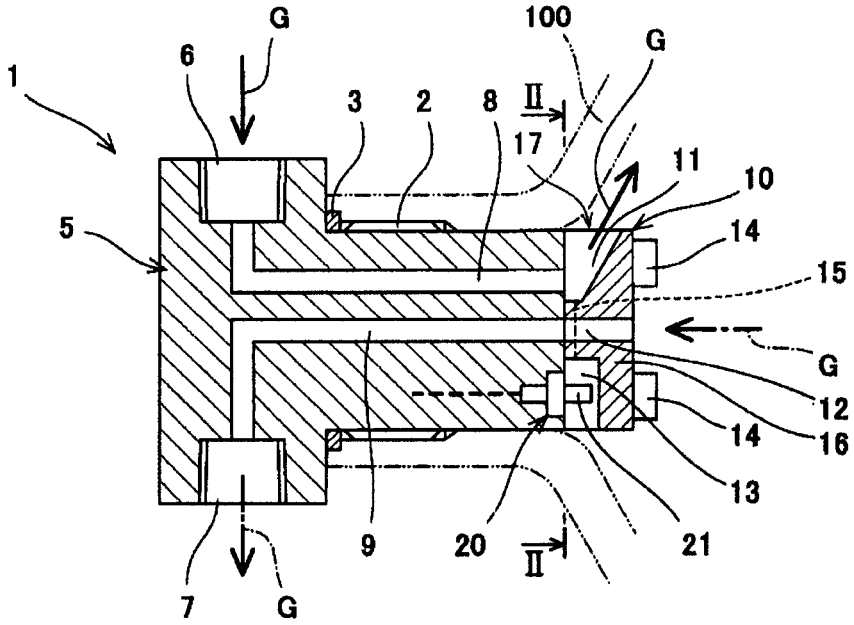
FIG. 1 is a cross-sectional view showing a valve portion of a fuel tank according to Embodiment 1 of the present invention.

As shown in FIG. 1, a fuel tank valve 1 of Embodiment 1 is attached to one end of the fuel tank 100 so as to be threaded into a threaded portion 2 and sealed by a seal ring 3. A valve main body 5 of the fuel tank valve 1 is provided with a filling port 6 at an upper portion thereof in FIG. 1 and an output port 7 at a lower portion thereof. A filling hole 8 communicating with the filling port 6 and an output hole 9 communicating with the output port 7 are formed so as to communicate with an inside of the tank 100. The output hole 9 is formed at a center of the valve main body 5, and the filling hole 8 is formed off-center.

In the present embodiment, a temperature sensor 20 and the filling hole 8 are provided symmetrically with respect to the center of the valve main body 5. The temperature sensor 20 is fixed to the valve main body 5, and a probe 21 that is a temperature sensing portion projects toward the inside of the tank 100. In FIG. 1, a dotted line shows an electric wire, and the electric wire is connected to a controller (not shown) configured to measure and monitor the temperature detected by the temperature sensor 20.

Further, a jet flow deflection piece 10 is provided at a tank inside portion of the valve main body 5. The jet flow deflection piece 10 includes a fuel ejecting portion 17, and the fuel ejecting portion 17 includes an ejection port 11 through which the fuel gas G to be filled in the tank 100 through the filling hole 8 is ejected at a predetermined angle relative to an axial direction of the tank 100. The jet flow deflection piece 10 is provided with an output hole 12 that communicates with the output hole 9 of the valve main body 5. The jet flow deflection piece 10 of the present embodiment is attached to the valve main body 5 by bolts 14.

Figure 2:
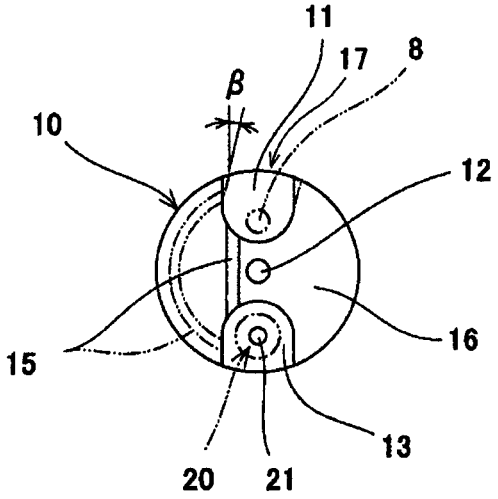
FIG. 2 is a diagram taken along line II-II of the valve portion of FIG. 1.

As also shown in FIG. 2, the ejection port 11 provided at the jet flow deflection piece 10 is formed on a side surface of the jet flow deflection piece 10, and the fuel gas G to be filled through the filling hole 8 is ejected through the ejection port 11 so as to be significantly inclined relative to the axial direction and therefore flow along a curved line of an inner surface of the tank 100. With this, the fuel gas G to be filled in the tank 100 flows along the tank inner surface and then diffuses in a tank rear end direction to be filled in the tank 100.

In the state shown in FIG. 2, the ejection port 11 is formed such that the fuel gas G is ejected in a radial direction perpendicular to the axial direction of the tank 100. However, the ejection port 11 may be formed such that the fuel gas G is ejected in a direction rotated about the filling hole 8 from the direction perpendicular to the axial direction by a predetermined angle β (a dashed line in FIG. 2) in a circumferential direction. The angle β is an inclination angle relative to a straight line connecting an axial center of the jet flow deflection piece 10 and the filling hole. By forming the ejection port 11 as above, the fuel gas G to be ejected through the ejection port 11 along the inner surface of the tank 100 can flow spirally at a predetermined angle. Thus, the local temperature increase of the tank 100 can be further suppressed.

In the jet flow deflection piece 10, a bulkhead portion 16 is formed between the fuel ejecting portion 17 and a temperature measuring portion 13 that is a predetermined space in which the temperature sensor 20 is provided.

As above, the jet flow deflection piece 10 includes the bulkhead formed between the fuel ejecting portion 17 configured to diffuse the fuel gas G to be filled and the temperature measuring portion 13 to which the temperature sensor 20 is attached. With this, the jet flow of the fuel gas G is prevented from directly hitting the probe 21 of the temperature sensor 20.

In the present embodiment, the fuel ejecting portion 17 and the temperature measuring portion 13 are provided symmetrically, that is, displaced from each other by 180°, so that the temperature change of the jet flow deflection piece 10 by the fuel gas G does not significantly influence the temperature change of the temperature measuring portion 13. As long as the fuel gas G does not directly hit the temperature sensor 20, the fuel ejecting portion 17 and the temperature measuring portion 13 may be provided so as to be displaced from each other by 90° or the other angle.

Further, in the present embodiment, the jet flow deflection piece 10 is provided with an introducing passage 15 through which a part of the fuel gas G to be filled in the tank through the fuel ejecting portion 17 is introduced into the temperature measuring portion 13 in which the temperature sensor 20 is provided. The introducing passage 15 is provided such that the fuel gas G introduced from the fuel ejecting portion 17 does not directly hit the probe 21 of the temperature sensor 20. To be specific, the introducing passage 15 is designed such that the probe 21 is not located on an extended line of the introducing passage 15. The introducing passage 15 may be formed in any shape as long as the fuel gas G does not directly hit the temperature sensor 20. Examples of the shape of the introducing passage 15 include a straight shape shown by a solid line in FIG. 2 and a circular-arc shape shown by a chain double-dashed line in FIG. 2.

The introducing passage 15 is provided on a surface of the jet flow deflection piece 10, the surface contacting the valve main body 5. The introducing passage 15 having a groove shape is formed by fixing the jet flow deflection piece 10 to the valve main body 5.

According to the fuel tank valve 1 configured as above, the fuel gas G to be filled in the tank 100 through the filling port 6, the filling hole 8, and the ejection port 11 is filled along the inner surface of the tank 100. Therefore, the fuel gas G can be stably filled in the tank 100 while suppressing the local temperature increase of the fuel tank 100 by the high-pressure fuel gas G.

The temperature of the fuel gas G to be filled can be precisely measured by the temperature sensor 20 provided at the valve main body 5. Therefore, a stable fuel gas filling operation can be performed while monitoring the temperature of the fuel gas G to be filled. In addition, in the present embodiment, the fuel gas G is introduced from the ejection port 11 through the introducing passage 15 to the temperature measuring portion 13 in which the temperature sensor 20 is provided. Therefore, the temperature of the fuel gas G in the vicinity of the valve main body 5 at the time of the filling operation can be more precisely measured and monitored.

Further, the fuel gas G to be filled does not directly hit the temperature sensor 20. Therefore, the temperature sensor 20 can be prevented from being damaged by the fuel gas G even at the time of a high-pressure fuel gas filling operation.

Figure 3:
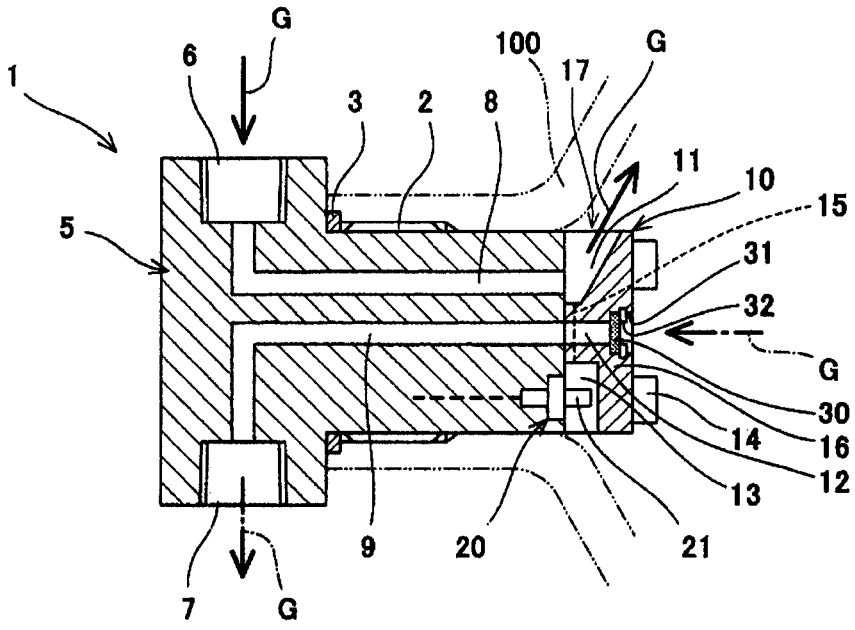
FIG. 3 is a cross-sectional view showing the valve portion of the fuel tank according to Embodiment 2 of the present invention.

FIG. 3 shows an example in which the jet flow deflection piece 10 is provided with a filter 30 configured to remove foreign matters in the fuel gas to be output through the output hole 9 to the output port 7. The components other than the filter 30 are the same as those of the fuel tank valve 1 described above. Therefore, the same reference signs are used for the same components, and explanations thereof are omitted.

In this example, a filter arranging portion 31 is formed at a tank inside portion of the output hole 12 of the jet flow deflection piece 10, and the filter 30 is arranged at the filter arranging portion 31 to be fixed by a C ring 32.

With this, even if the filter 30 provided at the jet flow deflection piece 10 as above clogs, breaks, or the like, the filter 30 can be easily replaced by replacing the jet flow deflection piece 10.

Figure 4:
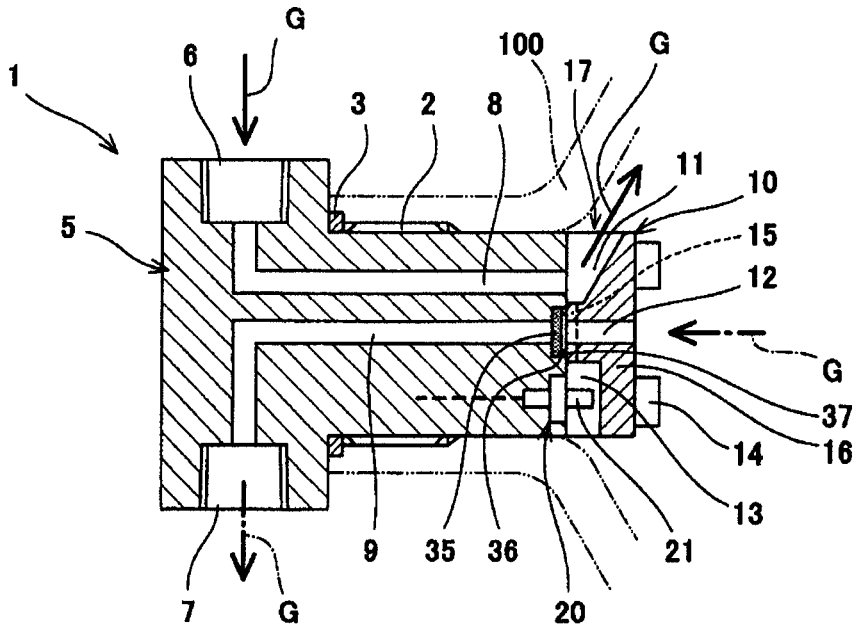
FIG. 4 is a cross-sectional view showing the valve portion of the fuel tank according to Embodiment 3 of the present invention.

As shown in FIG. 4, a filter 35 may be attached in such a manner that: a filter arranging portion 36 is formed at a portion of the output hole 9, the portion being located on a surface of the valve main body 5, the surface contacting the jet flow deflection piece 10; the filter 35 and a filter holder 37 (an elastic member, such as rubber) are arranged at the filter arranging portion 36; and the filter 35 and the filter holder 37 are pressed against the valve main body 5 by the jet flow deflection piece 10. In a case where the filter 35 is attached as above, the filter 35 can be easily replaced by detaching the jet flow deflection piece 10.

As above, an additional component, such as the filter 30 or 35 for an output line, may be attached to a portion where the jet flow deflection piece 10 that is formed separately from the valve main body 5 is provided. With this, unlike a case where the additional component, such as the filter 30 or 35, is directly fixed to the valve main body 5, the additional component can be easily replaced by replacing the jet flow deflection piece 10.

Figure 5:
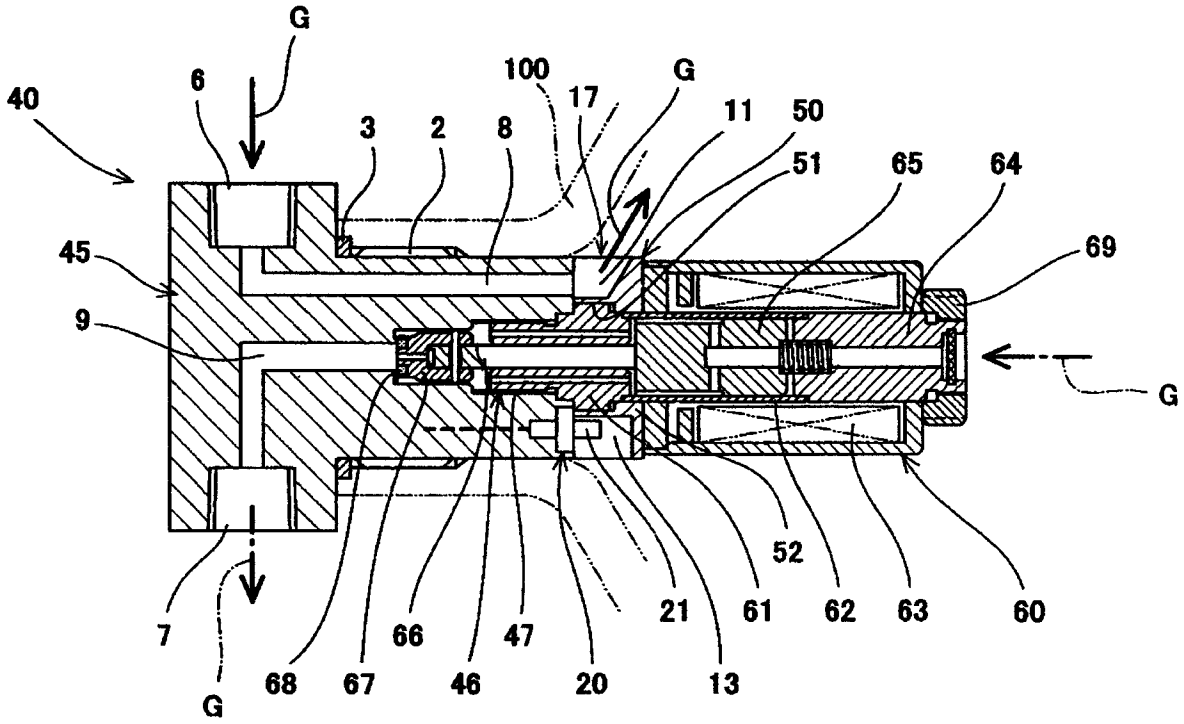
FIG. 5 is a cross-sectional view showing the valve portion of the fuel tank according to Embodiment 4 of the present invention.

As shown in FIG. 5, a fuel tank valve 40 of Embodiment 2 is provided with an on-off valve 60 located inside the tank 100 and configured to open and close the output hole 9. The same reference signs are used for the same components as in the fuel tank valve 1 of Embodiment 1, and explanations thereof are omitted.

A valve attaching portion 46 to which the on-off valve 60 is attached is provided at a tank inside portion of a valve main body 45 of the present embodiment. The valve attaching portion 46 is formed depending on the type of the on-off valve 60 and the like. In this example, a threaded portion 47 to which a fixed member 61 of the on-off valve 60 is fixed is provided.

A jet flow deflection piece 50 is provided with an opening portion 51 that externally fits the on-off valve 60 attached to the valve attaching portion 46. A substantially cylindrical projection, not shown, is formed at the jet flow deflection piece 50 so as to project toward the valve main body 45. By inserting the projection into a hole formed on the valve main body 45, the jet flow deflection piece 50 is positioned at an axial center position of the valve main body 45. The jet flow deflection piece 50 is also provided with a bulkhead portion 52 formed between the ejection port 11 and the opening portion 51.

Further, in the on-off valve 60, an exciting coil 63 is provided at an outer periphery of a tubular guide 62 provided at the fixed member 61, and a fixed magnetic pole 64 and a movable core 65 are provided inside the exciting coil 63. In a case where the movable core 65 is moved in the axial direction by exciting the exciting coil 63, a seat portion 68 provided at a tip end of a tip end member 67 coupled to the movable core 65 by a rod 66 is separated from the valve main body 45.

The fixed member 61 of the on-off valve 60 is fixed to the valve attaching portion 46 of the valve main body 45, and the opening portion 51 is placed at the position of the fixed member 61 while the projection provided on a surface, located at the valve main body 45 side, of the jet flow deflection piece 50 is inserted into the hole of the valve main body 45. With this, the jet flow deflection piece 50 is arranged at the center of the valve main body 45. Then, the jet flow deflection piece 50 is sandwiched between the exciting coil 63 of the on-off valve 60 and the valve main body 45. By fixing the exciting coil 63 by a nut 69, the jet flow deflection piece 50 is fixed between the exciting coil 63 and the valve main body 45.

The jet flow deflection piece 50 of the present embodiment is also provided with the ejection port 11 for the fuel gas G to be filled and the temperature measuring portion 13 in which the temperature sensor 20 configured to measure the temperature of the fuel gas G is provided. In the present embodiment, the large on-off valve 60 is provided at the tank inside portion of the valve main body 45. Therefore, as shown by the chain double-dashed line in FIG. 2, the introducing passage 15 through which a part of the fuel gas G is introduced from the ejection port 11 to the temperature measuring portion 13 is provided outside the opening portion 51 so as to be formed in a circular-arc shape.

The fuel tank valve 40 configured as above has an in-tank configuration in which the on-off valve 60 is provided inside the tank 100, and the fuel gas G to be filled in the tank is filled along the inner surface of the tank 100. Therefore, the tank 100 can be stably filled with the fuel gas G at high pressure while suppressing the local temperature increase of the fuel tank 100 by the high-pressure fuel gas G.

In addition, in the present embodiment, since a part of the fuel gas G is introduced from the ejection port 11 through the introducing passage 15 to the temperature measuring portion 13, the temperature of the fuel gas G in the vicinity of the valve main body 45 at the time of the filling operation can be precisely measured by the temperature sensor 20 provided at the valve main body 45. With this, the stable fuel gas filling operation can be performed while monitoring the temperature and velocity of the fuel gas G to be filled.

The temperature sensor 20 and the introducing passage 15 of the above embodiments are just examples. The introducing passage 15 may be suitably provided depending on the type of the temperature sensor 20 and the like, and these components are not limited to the above embodiments.

In the above embodiments, each of the jet flow deflection pieces 10 and 50 is formed as a column body having a predetermined height. However, each of the jet flow deflection pieces 10 and 50 may be formed as a polygonal column body or the other body. The shape of each of the jet flow deflection pieces 10 and 50 is not limited to the above embodiments as long as each of the jet flow deflection pieces 10 and 50 includes the ejection port 11, the temperature measuring portion 13, and the introducing passage 15.

Further, the above embodiments are just examples, and various modifications may be made within the spirit of the present invention. The present invention is not limited to the above embodiments.

INDUSTRIAL APPLICABILITY

The fuel tank valve according to the present invention can be utilized as a valve for a fuel tank that is filled with a high-pressure gas.

REFERENCE SIGNS LIST

1 fuel tank valve
5 valve main body
6 filling port
7 output port
8 filling hole
9 output hole
10 jet flow deflection piece
11 ejection port
12 output hole
13 temperature measuring portion
14 bolt
15 introducing passage
16 bulkhead portion
17 fuel ejecting portion
20 temperature sensor
21 probe
30 filter
31 filter arranging portion
35 filter
36 filter arranging portion
40 fuel tank valve
45 valve main body
46 valve attaching portion
50 jet flow deflection piece
51 opening portion
52 bulkhead portion
60 on-off valve
61 fixed member
100 fuel tank
G fuel gas

The invention claimed is:

1. A fuel tank valve comprising:

a valve main body including a filling port through which a fuel gas is filled in a tank and an output port through which the fuel gas in the tank is output; and a jet flow deflection piece through which the fuel gas to be filled through the filling port is ejected at a predetermined angle relative to an axial direction of the tank, wherein the jet flow deflection piece includes: a fuel ejecting portion including an ejection port through which the fuel gas is ejected into the tank; a temperature measuring portion in which a temperature sensor configured to measure a temperature of the fuel gas to be filled in the tank is provided; and an introducing passage through which a part of the fuel gas to he filled through the fuel ejecting portion is introduced into the temperature measuring portion.

2. The fuel tank valve according to claim 1, wherein:

the jet flow deflection piece includes a bulkhead portion formed between the temperature measuring portion and the fuel ejecting portion; and the introducing passage is provided at such a position that the fuel gas to be filled through the fuel ejecting portion does not directly hit the temperature sensor.

3. The fuel tank valve according to claim 1, wherein the jet flow deflection piece includes the ejection port formed on a side surface of the jet flow deflection piece such that the fuel gas is ejected along an inner surface of the tank.

4. The fuel tank valve according to claim 3, wherein the ejection port is formed such that the fuel gas is ejected in a direction rotated about a filling hole from a direction perpendicular to the axial direction of the tank by a predetermined angle in a circumferential direction, the filling hole communicating with the filling port.

5. The fuel tank valve according to claim 1, wherein the jet flow deflection piece includes: an output hole that communicates with the output port; and a filter configured to remove foreign matters in the fuel gas to be output through the output hole to the output port.

6. The fuel tank valve according to claim 1, wherein the valve main body includes a filter configured to remove foreign matters in the fuel gas to be output to the output port, the filter being provided on a surface of the valve main body, the surface being joined to the jet flow deflection piece.

7. The fuel tank valve according to claim 1, wherein:

the valve main body includes a valve attaching portion to which an on-off valve provided inside the tank is attached; and the jet flow deflection piece includes an opening portion that externally fits the on-off valve attached to the valve attaching portion.

* * * * *